US006345558B1

(12) United States Patent
Wilson

(10) Patent No.: US 6,345,558 B1
(45) Date of Patent: Feb. 12, 2002

(54) GEAR PLIERS APPARATUS AND METHOD OF USE

(76) Inventor: Toney Hugh Wilson, 295 Sinclair Dr., Sarasota, FL (US) 34240

( * ) Notice: Subject to any disclaimer, the term of this patent is extended or adjusted under 35 U.S.C. 154(b) by 0 days.

(21) Appl. No.: 09/606,449

(22) Filed: Jun. 29, 2000

(51) Int. Cl.[7] ..... B25B 7/02
(52) U.S. Cl. ..... 81/420; 81/426.5
(58) Field of Search ..... 81/418, 420, 424.5, 81/426.5

(56) References Cited

U.S. PATENT DOCUMENTS

| | | | | | |
|---|---|---|---|---|---|
| 613,355 | A | * | 11/1898 | Burton | 81/418 |
| 1,093,400 | A | * | 4/1914 | Gottfrid | 81/418 |
| 1,600,747 | A | * | 9/1926 | Yurkovitch | 81/420 |
| 2,630,729 | A | * | 3/1953 | Arner | 81/420 |
| 2,645,960 | A | * | 7/1953 | Pray | 81/424.5 |
| 4,944,739 | A | * | 7/1990 | Torre | 81/418 |
| 5,793,018 | A | * | 8/1998 | Jett | 81/426.5 |

* cited by examiner

*Primary Examiner*—Eileen P. Morgan
*Assistant Examiner*—Joni B. Danganan
(74) *Attorney, Agent, or Firm*—Dorothy S. Morse

(57) ABSTRACT

A manually operated gear pliers apparatus, and a method for its use, with opposing jaws having cut away and precisely configured distal ends that allow a secure fit between adjacent external teeth on a ratio gear in the quick-change rear end of a race vehicle, and also having stops for the front and back of a supported gear, so that one hot gear at a time can be rapidly and neatly extracted from the hot quick-change rear end and safely transported to an intermediate location pending further use, without the direct contact between hot gear, hot gear lube, and operator that can lead to operator injury. The present invention comprises two elongated, single-piece lever members pivotally connected at a fulcrum, each lever member having a straight lower handle with an insulated distal portion; an upper handle transitionally angled relative to the lower handle; and a jaw element perpendicularly extended with respect to the upper handle. Each lever member is preferably made from aluminum rod to quickly dissipate heat, with more than three-fourths of the jaw element distal ends cut away and formed into five angled, flat surfaces that extend at least two inches in length. The most anticipated application, although not limited thereto, is use during track testing, race practice, and qualifying sessions with race vehicles having a quick-change rear end to rapidly change out hot ratio gears as part of an effort to determine optimal vehicle performance under a specified set of track conditions.

20 Claims, 2 Drawing Sheets

GEAR PLIERS APPARATUS AND METHOD OF USE

BACKGROUND—FIELD OF INVENTION

This invention relates to devices used for handling automotive gears, specifically to a manually operated tong-like gear pliers apparatus, and a method for its use, which allows an operator to grab hold of a hot ratio gear in the quick-change rear end of a race vehicle and remove the gear quickly, with minimal risk of operator injury, and with little or no mess. The gear pliers have opposing jaw elements that each have more than three-fourths of its distal end cut away, with the remaining mass of each jaw element formed into five flat surfaces positioned at precise non-90° angles relative to one another which allow the jaw elements to securely fit between the external teeth on a multitude of sizes of ratio gears. The gear pliers jaw elements also have distal and proximal protuberances for contact with the back and front surfaces of a supported gear to keep the gear from slipping out of the grasp of the jaw elements during gear handling and transport, so that one hot gear at a time, covered in hot gear lube, can be promptly extracted by a mechanic from the hot quick-change rear end of a race vehicle, and thereafter quickly and securely transported to an intended location without the direct contact between the hot gear lube and the mechanic that typically causes hot gear lube on an extracted gear to soak through gloves and burn mechanic fingers. The most anticipated application, although not limited thereto, is use during track testing, race practice, and race qualifying sessions with race vehicles having a quick-change rear end to rapidly change out hot ratio gears as part of an effort to determine optimal vehicle performance under a specified set of track conditions.

BACKGROUND—DESCRIPTION OF PRIOR ART

A vehicle's transmission transfers engine power to the drive wheels through a set of gears that either multiply the torque or transfer it directly to the drive shaft depending on the driving needs. The transmission receives torque from the engine through the clutch assembly connected to the transmission's input shaft. The gears in a transmission adapt available engine power to meet the changing conditions of the road and provide optimum torque for a given engine speed. Smaller gears provide more torque at lower speeds and allow a vehicle to start moving or drive uphill. Larger gears provide less torque at higher speeds and allow the vehicle to run more efficiently at high speeds on level ground. Race vehicles may alternatively be driven on a variety of race circuits, to include high speed ovals, tri-ovals, ovals with chicanes to limit top speeds, and road courses with varying combinations of 90° turns, hairpins, S-curves, and carousel curves. In addition to the variations in track layout, optimum race vehicle performance is also affected by the number and type of elevation changes in a track, the length of the longest straight, the expected maximum speeds in different portions of the track, track surface conditions, anticipated weather, and desired fuel mileage. While personal vehicles may use only one standard set of gears throughout the life of the vehicle for all driving conditions, the personal and financial rewards of a win motivate race crews to discover every competitive advantage in race vehicle performance, sometimes including extensive track testing and frequent change-out of gears. When gears are changed in a transmission, it typically is allowed to cool, and then removed from the vehicle for gear exchange. However, when a race vehicle has a quick-change rear end, the exchange of gears can occur with the quick-change rear end in place and while the gears are still hot. The rapid replacement of hot gears in a race vehicle having a quick-change rear end can be messy since the extracted gears are covered with hot gear lube. Race crews typically use gloves to handle hot gears, however, the hot gear lube often soaks through gloves and burns mechanic fingers. A tool configured for reaching into the quick-change rear end of a race vehicle to grasp and securely handle a hot ratio gear, as well as stably transport the hot gear covered with hot gear lube to a desired intermediate location, would prevent race crew injury and minimize much of the mess normally associated with gear change-out.

The present invention discloses a manually operated device that can be used to remove and transport hot gears quickly and safely while protecting the operator's hands from the heat of an extracted gear, as well as the hot gear lube covering it. The gear pliers invention comprises two elongated, single-piece lever members pivotally connected at a fulcrum, each lever member further comprising a straight lower insulated handle; an upper handle transitionally angled with respect to the lower handle; and a jaw element perpendicularly extended with respect to the upper handle, the end of which is substantially cut away and precisely configured. The lower handles are of sufficient length to allow the gloved hand of a mechanic to easily grip them and use the gear pliers with confidence for rapidly grasping and transporting a gear covered with hot messy gear lube to a desired intermediate location pending future use. Insulation provided on the lower handles protects the mechanic's hands from any heat transfer from the hot gears, or the hot gear lube, that is conducted through the non-insulated portion of the lever members to the handles. Each lever member is preferably made from aluminum rod that has the ability to quickly dissipate heat. Five flat surfaces cut into the distal end of each jaw enable the jaws to fit between adjacent teeth of different race vehicle gears while also providing appropriate surface contact between the jaw elements and the gear teeth to facilitate secure removal and transport of the gear targeted for exchange. A protrusion at the distal end of each jaw element and a second protrusion near to its proximal end also provide stable surfaces between which the front and back of an extracted gear are supported during its removal from the quick-change rear end of a race vehicle and transport to a contaminant-free intermediate location pending future use. No tool, device, or method is known for the safe, secure removal and transport of hot quick-change rear end gears that has all of the advantages offered by the present invention.

SUMMARY OF INVENTION—OBJECTS AND ADVANTAGES

The primary object of this invention is to provide a manually operated gear pliers apparatus that can be used to remove and transport hot gears from the quick-change rear end of a race vehicle without operator discomfort or injury. A further object of this invention is to provide a manually operated gear pliers apparatus that can be used to rapidly extract a hot gear from a quick-change rear end and which quickly dissipates heat conducted from the gear as it is being held and transported to enhance operator safety. It is also an object of this invention to provide a gear pliers apparatus with opposing jaws configured to fit between adjacent external gear teeth on opposite sides of a ratio gear to facilitate gear removal and handling. It is a further object of this invention to provide a device adapted for removing hot quick-change rear end gears that securely positions the supported gear between its jaw elements until the operator is ready to release it. A further object of this invention is to provide a device that minimizes the mess created by hot gear lube soaked gears during the gear change-out process. It is also an object of this invention to provide a device for removing hot quick-change rear end gears that can be used in the handling of more than one size of gear. A further object of this invention is to provide a device for extracting and manipulating hot quick-change rear end gears that is light in weight and reliable for easy operator use.

As described herein, properly manufactured and used, the present invention provides a manually operated gear pliers apparatus that would allow a race crew member or mechanic to quickly and safely extract and transport with little or no mess, without injury or discomfort to hands, and without his or her gloves becoming soaked with hot gear lube, a hot gear from a hot quick-change rear end in a race vehicle so that during track testing and practice sessions conducted to determine optimum race vehicle performance, the race vehicle can be promptly returned to the track for additional performance testing. Since the gear pliers comprise two elongated, straight lower handles approximately seven to eight inches in length, it would be easy for a race crew member or mechanic to pick up and manipulate the gear pliers with a gloved hand. Further, since the lower handles are insulated, any heat conducted through the gear pliers from a hot gear or the hot gear lube covering an extracted gear would not burn or provide any discomfort to an operator's hand. The insulation would also improve the grip of a hand around the lower handles to provide a more secure grasp of the pliers during gear removal and transport. The single-piece construction of each gear pliers lever member enhances its durability and makes it more reliable during repeated use. Also, the pivotal connection of the transitionally angled upper handles at a fulcrum provides a range of jaw movement to accommodate different sizes of gears. Five flat surfaces positioned at precise angles relative to one another are cut into the inside portion of each jaw element to engage and support the straight external teeth of a ratio gear, and the flat surfaces extend nearly two-thirds of the length of each jaw element for a distance of at least two inches. Approximately three-fourths of the distal end circumference of each jaw element is cut away to form the five flat surfaces. Further, a protrusion at the tip of each jaw element and a second protrusion at the base of each jaw element provide stable surfaces between which the ratio gear is supported during gear extraction and transport. Thus, once the gear pliers are closed around a hot gear in the quick-change rear end of a race vehicle, the gear stays in place between the opposing gear pliers jaw elements during gear removal and transport until the operator is ready to release it. In addition, the use of aluminum rod in the preferred embodiment of the gear pliers makes its lever members light in weight, able to quickly dissipate heat, and easy to manipulate. Since a race crew member would be able to use the present invention to securely and indefinitely hold a hot quick-change rear end gear between its jaws until a convenient contaminant-free holding area could be found for the gear, the mess usually associated with hand removal of a quick-change rear end gear covered with hot gear lube would be minimized.

The description herein provides the preferred embodiments of the present invention but should not be construed as limiting the scope of the gear pliers invention. For example, the overall size of the lever members; the thickness of the insulation on the handles; the type of material used to construct the gear pliers; the type of fastener used at the fulcrum; and the length of the jaw elements, other than those shown and described herein, may be incorporated into the present invention. Thus, the scope of the present invention should be determined by the appended claims and their legal equivalents, rather than the examples given.

DETAILED DESCRIPTION OF PREFERRED EMBODIMENTS

Figure 1:
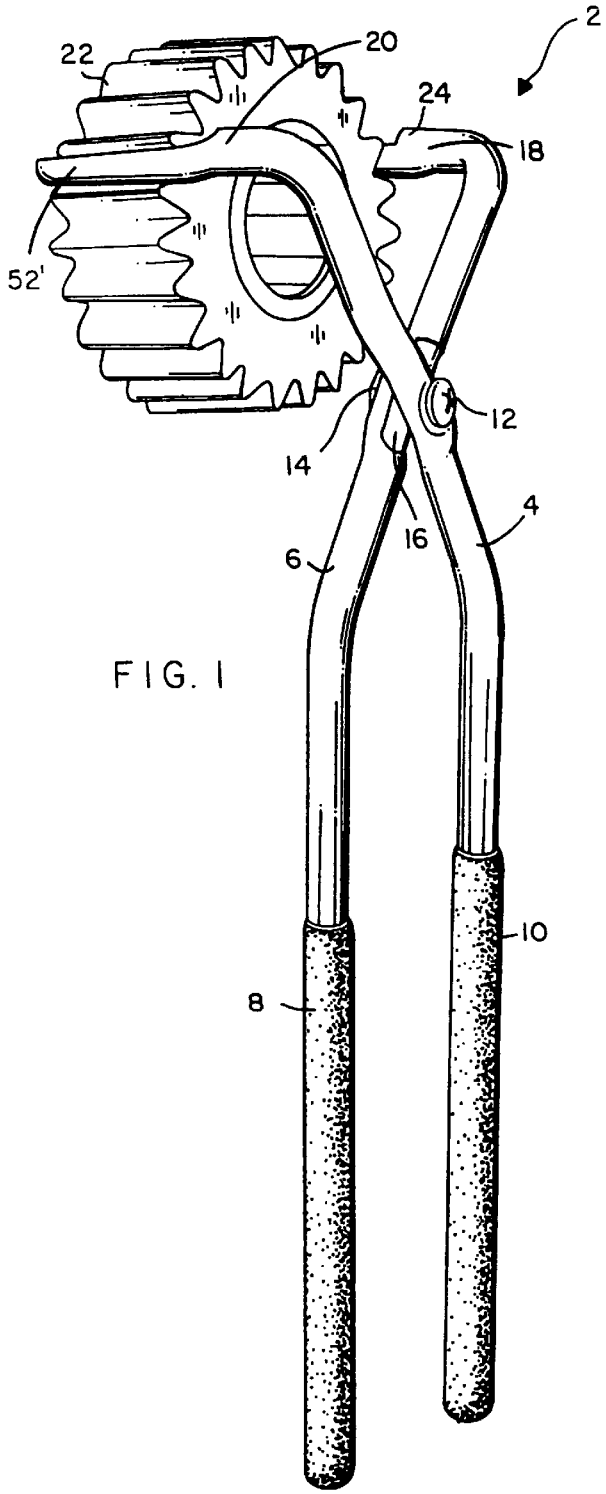
FIG. 1 is a perspective view of the most preferred embodiment of the gear pliers present invention holding a straight tooth gear between its jaw elements.
Figures 4, 5, 6:
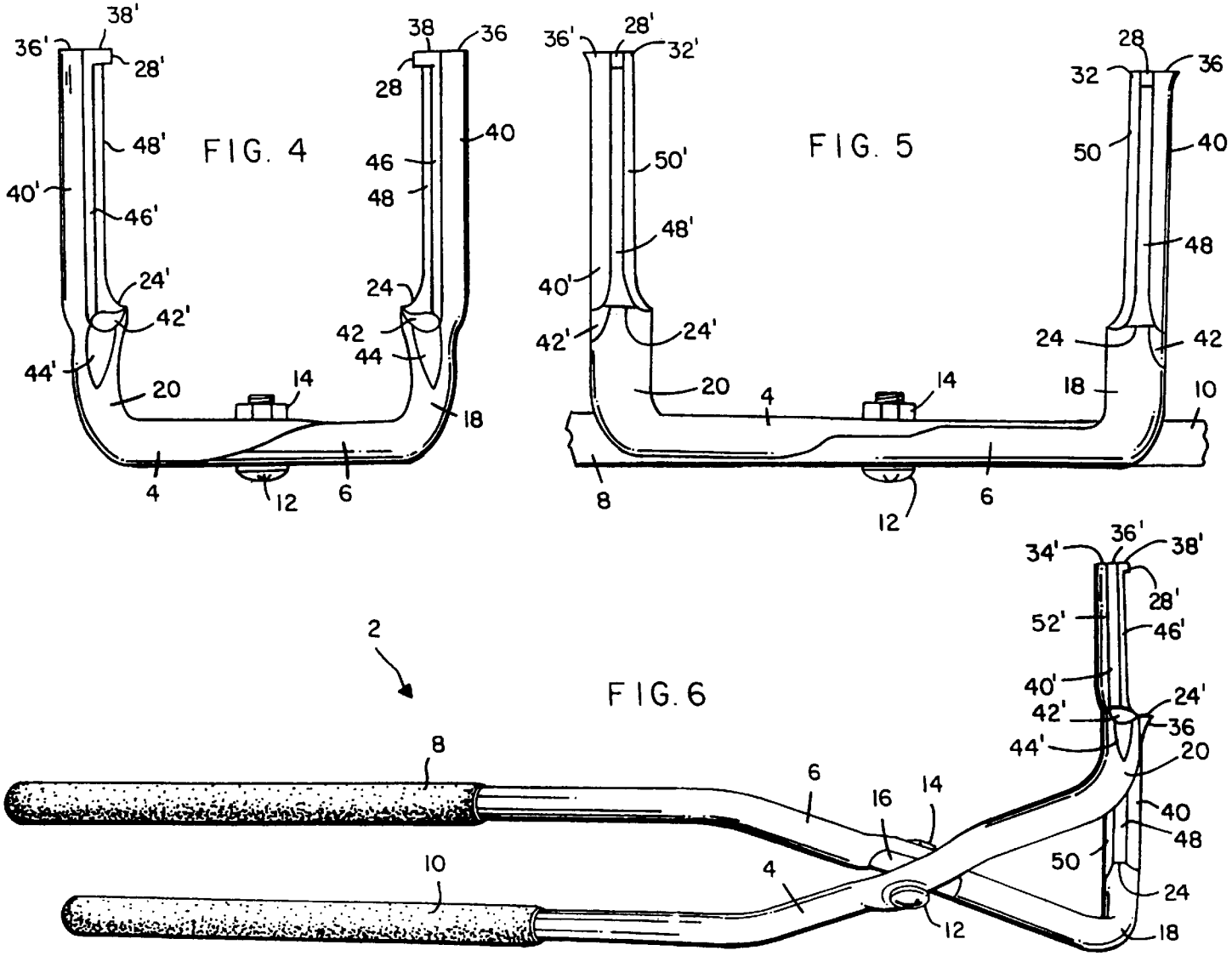
FIG. 4 is a top view of the gear pliers with the two jaw elements in an approximate position of minimum separation.
FIG. 5 is a top view of the gear pliers with the two jaw elements in an approximate position of maximum separation.
FIG. 6 is a perspective view of the gear pliers in a position of near minimum separation between its jaw elements.

As shown in FIGS. 1 and 6, the preferred embodiment of gear pliers 2 comprises a first lever member having a straight insulated lower handle 10, an upper handle 4 transitionally angled with respect to lower handle 10, and a jaw element 20 perpendicularly extended with respect to upper handle 4, as well as an opposing second lever member having a straight insulated lower handle 8, an upper handle 6 transitionally angled with respect to lower handle 8, and a jaw element 18 perpendicularly extended with respect to upper handle 6. The first and second lever members are pivotally connected at a fulcrum and secured together with a bolt 12 and a nut 14. It is contemplated for bolt 12 and nut 14 to be adequate in size to securely connect upper handles 4 and 6 for pivotal movement, however, bolt 12 and nut 14 should not be so large as to extend beyond flared protrusion 24 where they would block secure containment of a ratio gear, such as the ratio gear shown in FIG. 1 with gear teeth 22, between jaw elements 18 and 20. The first and second lever members are both elongated components having a single-piece construction. In the most preferred embodiment it is contemplated that both lever members be made from stock round aluminum rod and forged into the preferred shape. The length of lower handles 8 and 10 is sufficient to allow an operator (not shown) to comfortably grip and manipulate gear pliers 2 thereby while wearing gloves. Although not limited thereto, in the preferred embodiment, lower handles 8 and 10 are approximately seven-and-one-half inches long with insulation material it being attached to and approximately covering the lower five inches of handles 8 and 10. The insulation on lower handles 8 and 10 is made from a heat resistant material, such as a thin layer of rubber-like material that protects the operator's hands from heat conducted from the hot gear through jaw elements 18 and 20, upper handles 4 and 6, to lower handles 8 and 1O. The insulation material can also provide a slip-resistant grip for the operator during use. Although in the preferred embodiment it is contemplated for the insulation material covering lower handles 8 and 10 to have a smooth surface configuration, it is considered within the scope of the present invention for the insulation material to comprise a surface pattern or texture for an enhanced grip.

FIG. 1 also shows a flattened cutout surface 16 on upper handle 6, at the fulcrum between upper handle 6 and upper handle 4, with flattened cutout surface 16 facing upper handle 4. Although not shown in FIG. 1, it is also contemplated for upper handle 4 to have a similar flattened cutout surface at the fulcrum between upper handle 6 and upper handle 4, with the hidden flattened cutout surface on upper handle 4 facing upper handle 6. Flattened cutout surface 16 and the similar hidden flattened cutout surface on upper handle 4 each have a substantially rectangular configuration. The length of flattened cutout surface 16 and the similar hidden flattened cutout surface on upper handle 4 define the maximum separation possible between jaw elements 18 and 20. In a position of maximum separation between jaw elements 18 and 20, the outside upper corner of cutout surface 16 and the outside lower comer of the similar hidden flattened cutout surface on upper handle 4 would engage one another to prevent further lateral movement of jaw elements 18 and 20, at the same time that the outside lower comer of cutout surface 16 and the outside upper comer of the similar hidden flattened cutout surface on upper handle 4 would become engaged. Although FIG. 1 shows upper handle 4 connected rearward from upper handle 6, it is equally contemplated for upper handle 6 to be connected rearward from upper handle 4. Although not clearly shown in FIGS. 1 or 6, in the preferred embodiment of the present invention the surfaces of upper handle 6 and upper handle 4 opposed to cutout surface 16 and the similar hidden flattened cutout surface on upper handle 4, respectively, can have a flattened appearance.

FIG. 1 further shows upper handles 4 and 6 transitionally angled with respect to lower handles 10 and 8, respectively. In the preferred embodiment, the transition angle between lower handle 10 and upper handle 4 is approximately 150° degrees, and the transition angle between lower handle 8 and upper handle 6 is also approximately 150° degrees. FIG. 1 also shows the fulcrum of gear pliers 2 being located at the approximate midpoints of upper handles 4 and 6. Although not shown, holes through the approximate midpoints of upper handles 4 and 6 allow for insertion of bolt 12 that secures the first and second lever members together for pivotal movement. Nut 14 secures bolt 12 in place and keeps bolt 12 in position during use. In the preferred embodiment, flattened cutout surface 16 and the opposed hidden flattened cutout surface on upper handle 4 through which nut 14 secures bolt 12, are each approximately one inch in length and extend substantially the entire width of upper handle 6 and upper handle 4, respectively.

FIG. 1 also shows jaw elements 18 and 20 extending perpendicular to upper handles 6 and 4, respectively, and remaining approximately parallel to each other during use. In the preferred embodiment shown in FIG. 1, it is contemplated for jaw elements 18 and 20 to be mirror images of one another, and for the length dimension of each jaw element 18 and 20 to be approximately two and three-quarters inches, the overall length of jaw elements 18 and 20 not being critical as long as both have substantially the same length dimension. As shown in FIG. 1, jaw elements 18 and 20 are each configured to fit between adjacent external gear teeth 22 on opposing sides of a ratio gear to facilitate removal and transport of the gear to a contaminant-free intermediate location pending reuse. The configuration allows jaw elements 18 and 20 to support gear teeth 22 above, in line with, as well as below the central axis of the gear. FIG. 1 further shows the uncut, outer surface 52' of jaw element 20 being sufficiently narrow in width to fit between two adjacent gear teeth 22. FIG. 1 also shows a flared protrusion 24 on jaw element 18, near to the interface between jaw element 18 and upper handle 6. Although not shown in FIG. 1, a similar protrusion that is identified as flared protrusion 24' in FIGS. 4 and 5 would be positioned on jaw element 20 near to the interface between jaw element 20 and upper handle 4. Although not clearly shown in FIG. 1, flared protrusions 24 and 24' would each have a flared-out flat surface configured to engage the exposed surface of a ratio gear so that when gear pliers 2 are tipped from a substantially vertical orientation wherein jaw elements 18 and 20 become positioned above upper handles 4 and 6, the flared-out flat surfaces on flared protrusions 24 and 24' help to maintain jaw elements 18 and 20 tightly between adjacent gear teeth 22 and the ratio gear securely supported by gear pliers 2.

Figure 2:
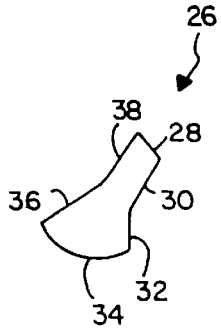
FIG. 2 is an enlarged, detailed end view of the jaw element tip on the second lever member.
Figure 2A:
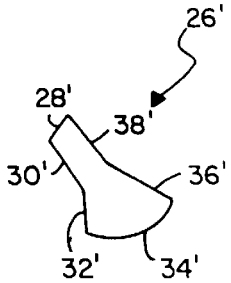
FIG. 2*a* is an enlarged, detailed end view of the jaw element tip on the first lever member.

FIGS. 2 and 2*a* show end 26 and end 26' of jaw elements 18 and 20, respectively, with ends 26 and 26' substantially being mirror images of one another. In FIG. 2, bottom edge 34 represents the distal boundary of the original uncut surface of the rod used to make jaw element 18, not shown in any other illustration but similar to the original uncut surface 52' of jaw element 20 shown in FIG. 3. To identify the remaining edges in FIG. 2 in clockwise order, starting with bottom edge 34, the next adjacent edge 36 represents the distal boundary of the relatively broad first outer cut surface 40 in jaw element 18, shown in FIGS. 4 and 5. Moving further clockwise, the next adjacent surface in FIG. 2 is edge 38 representing the distal boundary of a second more narrow outer cut surface 46, shown in FIG. 4. Again moving clockwise, the next adjacent surface in FIG. 2 is distal end protrusion 28, the outward extension of gear contact surface 48, shown in FIGS. 4 and 5. Moving clockwise from distal end protrusion 28, the next adjacent edge 30 corresponds to the distal boundary of a first narrow inner cut surface that is not shown in any of the illustrations but is substantially parallel to outer cut surface 46 and positioned on the opposing side of gear contact surface 48, between gear contact surface 48 and a second relatively broad inner cut surface 50. Finally, moving clockwise from edge 30, edge 32 represents the distal boundary of second inner cut surface 50. FIG. 2*a* shows the end view of jaw element 20, with edge 34' representing the distal boundary of uncut rod surface 52'; edge 36' representing the distal boundary of broad first outer cut surface 40'; edge 38' representing the distal boundary of narrow second outer cut surface 46'; distal end protrusion 28' representing the outward extension of a gear contact surface 48'; edge 30' corresponding to the distal boundary of a first narrow inner cut surface that is not shown in any of the illustrations but is substantially parallel and similar in configuration to narrow second outer cut surface 46, and positioned between gear contact surface 48' and a second relatively broad inner cut surface 50'; and an edge 32' representing the distal boundary of second inner cut surface 50'.

Figure 3:
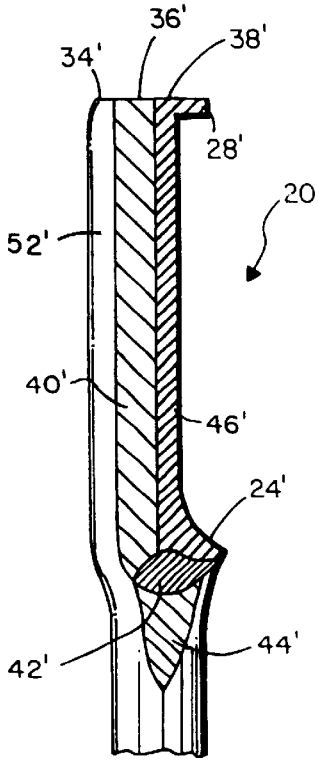
FIG. 3 is an enlarged, detailed, top view of the jaw element on the first lever member.

FIG. 3 shows an enlarged view of some of the five flattened surfaces cut out of the distal end of jaw element 20. Although not shown in FIG. 3, it is contemplated for the distal end of jaw element 18 to display five flattened surfaces nearly identical to that shown in FIG. 3, but in reversed positions that are mirror images of the flattened surfaces shown. FIG. 3 shows the original uncut surface 52' of jaw element 20 extending to distal boundary edge 34'. In FIG. 3, the end of uncut surface 52' tapers inward slightly as it approaches edge 34'. FIG. 3 also shows broad first outer cut surface 40' adjacent to uncut surface 52' and extending toward distal boundary edge 36', as well as narrow second outer cut surface 46' adjacent to first outer cut surface 40' and extending toward distal boundary edge 38'. As can be seen in FIG. 2*a* between distal boundary edges 36' and 38', the interface between broad first outer cut surface 40' and narrow second outer cut surface 46' forms an obtuse angle. Adjacent to narrow second outer cut surface 46', but not shown in FIG. 3, would be gear contact surface 48' (clearly seen in FIGS. 4 and 5) extending between distal end protrusion 28' and flared protrusion 24'. FIG. 3 further shows a vertically oriented shaved surface 44' that is created by shaving off small amounts of the original uncut surface 52' of the round aluminum rod material used to make the preferred embodiment jaw element 20. Shaved surface 44' provides better clearance on jaw element 20 when it is placed between external gear teeth 22 during removal and transport of a ratio gear. FIG. 3 also shows a fillet surface 42' blending four surfaces for a smooth surface transition at the base end of jaw element 20 to include shaved surface 44', the small side edge of flared protrusion 24', broad first outer cut surface 40', and narrow second outer cut surface 46'. As a result, outer cut surfaces 40' and 46' are bounded vertically between fillet surface 42' and the distal boundary edges 36' and 38', respectively. Although not shown, outer cut surfaces 40' and 46', as well as fillet surface 42', each have a substantially similar un-numbered counterpart on the hidden side of jaw element 20. In contrast, shaved surface 44', which provides additional clearance for jaw element 20 while engaging gear teeth 22, is not needed on the hidden side of jaw element 20 and has no counterpart.

FIG. 4 illustrates the configuration of jaw elements 18 and 20 in a position of minimum separation, when viewed from the top end of gear pliers 2. FIG. 4 shows upper handles 4 and 6 each connected for pivotal movement at a fulcrum by bolt 12 and nut 14. Lower handles 8 and 10 would remain hidden behind upper handles 4 and 6, respectively. In FIG. 4 jaw element 20 depends from upper handle 4 at an approximate right angle to upper handle 4, while jaw element 18 is shown depending from upper handle 6 at an approximate right angle thereto and in a position substantially parallel to jaw element 20. FIG. 4 also shows protrusions 28 and 28' extending substantially toward one another, with flared protrusions 24 and 24' also positioned to extend toward one another. Between protrusion 28 and flared protrusion 24, FIG. 4 shows two flat surfaces, identified as gear contact surface 48 and narrow second outer cut surface 46. FIG. 4 similarly shows two flat surfaces, identified as gear contact surface 48' and narrow second outer cut surface 46', between protrusion 28' and flared protrusion 24'. FIG. 4 further shows broad first outer cut surfaces 40 and 40' positioned adjacent to narrow second outer cut surface 46 and narrow second outer cut surface 46', respectively. Additionally, broad first outer cut surface 40 extends toward distal boundary 36, narrow second outer cut surface 46 extends between fillet surface 42 and distal boundary 38, and gear contact surface 48 extends between fillet surface 42 and protrusion 28, while broad first outer cut surface 40' extends toward distal boundary 36', narrow second outer cut surface 46' extends between fillet surface 42' and distal boundary 38' and gear contact surface 48' extends between fillet surface 42' and protrusion 28'. FIG. 4 also shows longitudinally extending shaved surfaces 44 and 44' that are created by shaving off small amounts of the original round aluminum rod material used to make jaw elements 18 and 20, respectively to provide better clearance when jaw elements 18 and 20 are placed between the external gear teeth 22 of a ratio gear during its extraction and movement away from a quick-change rear end. In the preferred embodiment shown in FIG. 4, the position of minimum separation possible between protrusions 28 and 28' is approximately two inches and is limited by the distance through which the distal ends of lower handles 8 and 10 move as they are forced toward one another, minimum separation being achieved when lower handles 8 and 10 come in contact with one another. Fillet surfaces 42 and 42' each blend three surfaces for a smooth surface transition between them. Fillet surface 42 provides a smooth transition for shaved surface 44, first outer cut surface 40, and second outer cut surface 46, while fillet surface 42' provides a smooth transition for shaved surface 44', first outer cut surface 40', and second outer cut surface 46'. Although not clearly shown in FIG. 4, protrusions 24 and 24' provide a stable flattened surface against which the front surfaces of a ratio gear can rest while it is being held between jaw elements 18 and 20 so that when gear pliers 2 are tipped from a substantially vertical orientation wherein jaw elements 18 and 20 become positioned above upper handles 4 and 6, the flared-out flat surfaces on flared protrusions 24 and 24' help to maintain jaw elements 18 and 20 tightly between adjacent gear teeth 22 and the ratio gear securely supported by gear pliers 2. Protrusions 28 and 28' provide opposing surfaces respectively for protrusions 24 and 24' and against which the back surfaces of the external gear teeth 22 of a ratio gear can rest while it is being held between jaw elements 18 and 20. The area within which a ratio gear can be contained by jaw elements 18 and 20 is further defined by the five flat surfaces previously mentioned, broad first outer cut surfaces 40 and 40'; narrow second outer cut surfaces 46 and 46'; gear contact surfaces 48 and 48'; second inner cut surfaces 50 and 50', and the two first narrow inner cut surfaces that are not shown in any of the illustrations but are substantially parallel to outer cut surfaces 46 and 46' respectively on jaw elements 18 and 20, and positioned on the opposing side of gear contact surfaces 48 and 48', respectively, with one being positioned between gear contact surfaces 48 and second broad inner cut surface 50, and the other being positioned between gear contact surfaces 48' and second broad inner cut surface 50'.

FIG. 5 shows the configuration of jaw elements 18 and 20 in a position of maximum separation, when viewed from the top end of gear pliers 2. FIG. 5 shows upper handles 4 and 6 each connected for pivotal movement at a fulcrum by bolt 12 and nut 14, with lower handles 8 and 10 extending laterally beyond upper handles 4 and 6, respectively. In FIG. 5, jaw element 20 is shown depending from upper handle 4 at an approximate right angle to upper handle 4, while jaw element 18 is shown depending from upper handle 6 at an approximate right angle thereto and in a position substantially parallel to jaw element 20. FIG. 5 also shows protrusions 28 and 28' extending substantially parallel to one another, with flared protrusions 24 and 24' also in positions substantially parallel to one another rather than facing one another as shown in FIG. 4. Between protrusion 28 and flared protrusion 24, FIG. 5 shows two flat surfaces, gear contact surface 48 and second broad inner cut surface 50. FIG. 5 similarly shows two flat surfaces, gear contact surface 48' and second broad inner cut surface 50', between protrusion 28' and flared protrusion 24'. FIG. 5 further shows broad first outer cut surfaces 40 and 40' positioned adjacent to gear contact surfaces 48 and 48', respectively. Broad first outer cut surfaces 40 and 40' are shown positioned on opposite sides of gear contact surfaces 48 and 48', respectively, from second broad inner cut surfaces 50 and 50'. Additionally, broad first outer cut surface 40 extends between fillet surface 42 and distal boundary 36, gear contact surface 48 extends between flared protrusion 24 and protrusion 28, and second broad inner cut surface 50 extends toward distal boundary 32, while broad first outer cut surface 40' extends between fillet surface 42' and distal boundary 36', gear contact surface 48' extends between flared protrusion 24' and protrusion 28', and second broad inner cut surface 50' extends toward distal boundary 32'. In FIG. 5, the upper ends of broad first outer cut surfaces 40 and 40' have an outwardly tapered configuration near to distal boundaries 36 and 36', respectively, while the upper ends of second broad inner cut surfaces 50 and 50' have an inwardly tapered configuration near to distal boundaries 32 and 32', respectively. FIG. 5 does not show longitudinally extending shaved surfaces 44 and 44', but a glimpse of fillet surfaces 42 and 42' are evident directly below broad first outer cut surfaces 40 and 40', respectively. In the preferred embodiment shown in FIG. 5, the position of maximum separation possible between protrusions 28 and 28' is approximately four-and-one-half inches and is limited by the perimeter edges of cutout flattened surface 16 and the similar hidden cutout flattened surface opposing it at the fulcrum between upper handles 4 and 6. During use of gear pliers 2, jaw elements 18 and 20 are opened to a position of near maximum extension, and then closed against the external gear teeth 22 on opposing sides of a ratio gear, as shown in FIG. 1, for secure containment of the gear between jaw elements 18 and 20, protrusions 28 and 28', as well as flared protrusions 24 and 24'. The area within which a ratio gear can be contained by jaw elements 18 and 20 is further defined by the five flat surfaces previously mentioned, broad first outer cut surfaces 40 and 40'; narrow second outer cut surfaces 46 and 46'; gear contact surfaces 48 and 48'; second inner cut surfaces 50 and 50', and the two first narrow inner cut surfaces that are not shown in any of the illustrations but are substantially parallel to outer cut surfaces 46 and 46' respectively on jaw elements 18 and 20, and positioned on the opposing side of gear contact surfaces 48 and 48', respectively, with one first narrow inner cut surface positioned between gear contact surfaces 48 and second broad inner cut surface 50, and the other positioned between gear contact surfaces 48' and second broad inner cut surface 50'.

FIG. 6 shows the gear pliers 2 of the present invention having a first lever member with a straight insulated lower handle 10, an upper handle 4 transitionally angled with respect to lower handle 10, and a jaw element 20 perpendicularly extended with respect to upper handle 4, as well as an opposing second lever member having a straight insulated lower handle 8, an upper handle 6 transitionally angled with respect to lower handle 8, and a jaw element 18 perpendicularly extended with respect to upper handle 6. The first and second lever members are pivotally connected at a fulcrum and secured together with a bolt 12 and a nut 14. It is contemplated for bolt 12 and nut 14 to be adequate in size to securely connect upper handles 4 and 6 for pivotal movement, however, bolt 12 and nut 14 should not be so large as to extend beyond flared protrusion 24 where they would interfere with the secure containment of a ratio gear between jaw elements 18 and 20, such as the type of gear shown in FIG. 1 with external gear teeth 22. Centrally positioned on the surface of upper handle 6 facing upper handle 4 and spanning the area on either side of the fulcrum, FIG. 6 shows flattened cutout surface 16. Although not shown, it is contemplated for upper handle 4 to also have a flattened cutout surface centrally thereon on the surface facing upper handle 6. As shown in FIG. 6, the first and second lever members are both elongated components having a single-piece construction, with the distal ends of lower handles 8 and 10 each being insulated to protect the hands of an operator (not shown) from injury when gear pliers 2 is placed in contact with a hot ratio gear, hot gear lube, and/or the hot rear end of a race vehicle (not shown) while gear pliers 2 is employed to extract a hot gear from a hot quick-change rear end. Since the lower ends of lower handles 8 and 10 are not in contact with one another and appear approximately parallel to each other in FIG. 6, jaw elements 18 and 20 are oriented between positions of minimum and maximum separation, similar to the orientation jaw elements 18 and 20 illustrated in FIG. 1 as they support the external gear teeth 22 of a ratio gear. In addition, FIG. 6 shows jaw element 18 positioned behind jaw element 20, with jaw element 20 appearing substantially the same as it is shown in FIG. 3. Protrusions 24 and 24' are directed toward one another, as are gear contact surfaces 48 and 48' (shown more clearly in FIGS. 4 and 5). Further in FIG. 6, jaw element 18 is shown substantially as it appears in FIG. 5, with gear contact surface 48 positioned between second broad inner cut surface 50 and broad first outer cut surface 40, the remainder of jaw element 18 being hidden from view behind jaw element 20.

To quickly extract a ratio gear, similar to the gear illustrated in FIG. 1 with straight external gear teeth 22, from the quick-change rear end of a race vehicle (not shown) while using the gear pliers 2 of the preferred embodiment of the present invention, an operator (not shown) would grasp the tong-like gear pliers 2 in one hand by insulated lower handles 8 and 10. The first and second lever members, of which insulated lower handles 8 and 10 represent the lowermost part, would then each be rotated about the fulcrum between upper handles 4 and 6 into the position of near maximum separation, as shown in FIG. 5. The operator then would position gear pliers 2 so that gear contact surfaces 48 and 48' are each approximately centered between adjacent external gear teeth 22 on opposite sides of the ratio gear from one another, and protrusions 28 and 28' are positioned behind gear teeth 22, remote from the operator. Contact between jaw elements 18 and 20 and external gear teeth 22 can occur with gear teeth 22 located above, in line with, or below the central axis of the gear. When properly positioned relative to gear teeth 22, the first and second lever members are again rotated about the fulcrum to close jaw elements 18 and 20 around gear teeth 22 and place contact surfaces 48 and 48' solidly against adjacent gear teeth 22 on opposing sides of the gear. The operator would then apply sufficient additional rotational pressure on lower handles 8 and 10 to firmly grasp and secure gear teeth 22 between jaw elements 18 and 20. When gear teeth 22 are hot, the aluminum material from which gear pliers 2 are preferably made would quickly dissipate any heat from gear teeth 22, or from the hot gear lube covering gear teeth 22, that becomes conducted through jaw elements 18 and 20 to upper handles 4 and 6, or to lower handles 8 and 10. After gear teeth 22 are firmly positioned within and supported by jaw elements 18 and 20, the operator would move gear pliers 2 away from the quick-change rear end, thus simultaneously sliding the gear out of the quick-change rear end. Protrusions 28 and 28' provide a stop against which the back of gear teeth 22 can rest while the gear and gear pliers 2 are moved in unison away from the quick-change rear end. By subsequently releasing the grip on lower handles 8 and 10 and moving lower handles 8 and 10 away from one another, the operator can release gear teeth 22 from jaw elements 18 and 20 and place the ratio gear in a desired intermediate location without a mess. Where it is in the interest of operator safety, or where otherwise advantageous, a ratio gear could also be installed in a hot quick-change rear end (not shown) through use of gear pliers 2 by reversing the above steps. For such installation, flared protrusions 24 and 24' would act as stops against which the front surface of gear teeth 22 would rest while the gear and gear pliers 2 are moved in unison toward the quick-change rear end and the gear is allowed to slide into the desired position within the quick-change rear end.

Although not limited thereto, the following dimensions are contemplated for the most preferred embodiment of the gear pliers 2 invention. In the most preferred embodiment the overall length dimension of each lever member of gear pliers 2 would be approximately twelve inches, with the length dimension of lower handles 8 and 10 each being approximately seven-and-one-half inches, the length dimension of upper handles 4 and 6 each being approximately five inches, and the length dimension of jaw elements 18 and 20 each being approximately two-and-three-fourths inches. It is also contemplated for the most preferred embodiment of gear pliers 2 to be forged from round aluminum rod that is approximately three-eighths of an inch in diameter, for the insulation on lower handles 8 and 10 to be approximately five inches in length, and for the thickness of the insulation on lower handles 8 and 10 to be approximately one-thirty-second of an inch. In the most preferred embodiment, the shaft of bolt 12 would be approximately one-fourth of an inch in diameter, with the overall length dimension of bolt 12 being approximately seven-eighths of an inch. Also, in the most preferred embodiment flattened cutout surface 16 on upper handle 6 and its similar hidden un-numbered counterpart on upper handle 4 would each have a length dimension of approximately one inch and a width dimension of approximately seven-sixteenths of an inch. Further in the most preferred embodiment, the ends 26 and 26' of jaw elements 18 and 20, respectively, would have the following substantially similar dimensions. The length dimensions of distal boundaries 38 and 38' would each be approximately one-eighth of an inch, the length dimensions of distal boundaries 30 and 30' are each approximately five-thirty-seconds of an inch, the length dimensions of distal boundaries 36 and 3' are each approximately three-sixteenths of an inch, and the length dimensions of distal boundaries 32 and 32' are each approximately one-eighth of an inch. Further, the width dimensions of protrusions 28 and 28' are each approximately one-eighth of an inch, the greatest length dimensions between the ends of protrusions 28 and 28', respectively, with bottom edges 34 and 34' representing the distal boundaries of the original uncut surfaces 52 and 52' is approximately eleven-thirty-seconds of an inch, the angles between distal boundaries 32 and 32', respectively, with distal boundaries 30 and 30' are each approximately 135°, and the angles between distal boundaries 36 and 36', respectively, with distal boundaries 38 and 38' are each approximately 150°. Also, as shown in FIG. 3, the greatest width dimension of jaw elements 18 and 20, extending from flared protrusions 24 and 24' to original uncut surfaces 52 and 52', respectively, are each approximately one-half inch. In addition, when jaw elements 18 and 20 of the most preferred embodiment of the present invention are placed at a position of minimum separation, the distance between protrusions 28 and 28' is approximately two-and-one-eighth inches, the distance between flared protrusions 24 and 24' is approximately one-and-fifteen-sixteenths of an inch, and the distance between gear contact surfaces 48 and 48' mid-range between protrusions 28 and 28' and flared protrusions 24 and 24', respectively, is approximately two-and-five-sixteenths of an inch. Such dimensions permit jaw elements 18 and 20 to grasp and support a gear by external teeth 22 located above, in line with, or below the central axis of the gear.

What is claimed is:

1. A manually operated device for rapidly grasping and securely holding different sizes of ratio gears having straight external gear teeth, and gears covered with hot gear lube, said device comprising:

two elongated, single-piece lever members each having a straight lower handle, an upper handle transitionally angled with respect to said lower handle, and a jaw element perpendicularly extended with respect to said upper handle, each of said lower handles having a distal portion, each of said upper handles centrally joined to one another for pivotal movement relative to the other, said jaw elements each having a distal end protrusion, a proximal end flared protrusion longitudinally aligned with said distal end protrusion, and five cutout flat surfaces positioned between said distal end protrusion and said proximal end flared protrusion;

connection means adapted for pivotally securing said upper handles to one another; and insulation means adapted for thermally insulating said distal portions of said lower handles against temperatures typically anticipated in hot gear lube covering a gear extracted from a quick-change rear end of a race vehicle so that when a gear with straight external gear teeth is positioned between said jaw elements and said lower handles are each moved toward one another by an operator, said jaw elements are brought in contact with the gear between adjacent external gear teeth on opposing sides of the gear to quickly grasp and securely hold the gear, and thereby protecting the operator from the risk of injury possible through direct contact with the hot gear and hot gear lube.

2. The device of claim 1 wherein each of said five flat surfaces positioned at non-90° angles relative to one another.

3. The device of claim 1 wherein each of said five flat surfaces have a length dimension of approximately two inches.

4. The device of claim 1 wherein two of said five flat surfaces are positioned adjacent to one another and separated by an angle of approximately 150°, and a different two of said five flat surfaces are positioned adjacent to one another and separated by an angle of approximately 135°.

5. The device of claim 1 wherein said connection means comprises a nut and a bolt.

6. The device of claim 1 wherein each of said lever members is forged from three-eighths inch diameter aluminum rod.

7. The device of claim 1 further comprising two opposing fillet surfaces on each of said jaw elements, each of said fillet surfaces bordering said flared protrusion and a portion of said flat surfaces.

8. The device of claim 7 wherein each of said jaw elements further comprises a shaved surface adjacent to the one of said fillet surfaces that is remote to said bolt, each of said shaved surfaces extending from said remote fillet surface in a direction opposed to said flat surfaces.

9. The device of claim 1 wherein each of said upper handles further comprises a central flattened cutout surface adapted to facilitate pivotal connection of said upper handles to one another, and wherein each of said flattened cutout surfaces has a perimeter edge and wherein said perimeter edges are adapted to function as a stop to define a position of maximum separation between said distal end protrusions.

10. A manually operated device for rapidly grasping and securely holding different sizes of ratio gears having straight external gear teeth and gears covered with hot gear lube, said device comprising:

two elongated, single-piece lever members each having a straight lower handle, an upper handle transitionally angled with respect to said lower handle, and a jaw element perpendicularly extended with respect to said upper handle, each of said lower handles having a distal portion, each of said upper handles centrally joined to one another for pivotal movement relative to the other, said jaw elements each having a distal end protrusion, a proximal end flared protrusion longitudinally aligned with said distal end protrusion, and five cutout flat surfaces positioned between said distal end protrusion and said proximal end flared protrusion, each of said five flat surfaces positioned at non-90° angles relative to one another;

connection means adapted for pivotally securing said upper handles to one another; and insulation means adapted for thermally insulating said distal portions of said lower handles against temperatures typically anticipated in hot gear lube covering a gear extracted from a quick-change rear end of a race vehicle so that when a gear with straight external gear teeth is positioned between said jaw elements and said lower handles are each moved toward one another by an operator, said jaw elements are brought in contact with the gear between adjacent external gear teeth on opposing sides of the gear to quickly grasp and securely hold the gear, and thereby protecting the operator from the risk of injury possible through direct contact with the hot gear and hot gear lube.

11. The device of claim 10 wherein two of said five flat surfaces are positioned adjacent to one another and separated by an angle of approximately 150°, and a different two of said five flat surfaces are positioned adjacent to one another and separated by an angle of approximately 135°.

12. The device of claim 10 further comprising two opposing fillet surfaces on each of said jaw elements, each of said fillet surfaces bordering said flared protrusion and a portion of said flat surfaces.

13. The device of claim 12 wherein each of said jaw elements further comprises a shaved surface adjacent to the one of said fillet surfaces that is remote to said bolt, each of said shaved surfaces extending from said remote fillet surface in a direction opposed to said flat surfaces.

14. The device of claim 10 wherein each of said upper handles further comprises a central flattened cutout surface adapted to facilitate pivotal connection of said upper handles to one another, and wherein each of said flattened cutout surfaces has a perimeter edge and wherein said perimeter edges are adapted to function as a stop to define a position of maximum separation between said distal end protrusions.

15. A method for quickly, safely, and securely grasping and temporarily holding hot gears and gears covered with hot gear lube, said method comprising the steps of:

providing two elongated pivotally connected lever members each having a straight insulated lower handle, an upper handle transitionally angled with respect to said lower handle, and a jaw element perpendicularly extended with respect to said upper handle with a distal end protrusion, a proximal end flared protrusion, and five cutout flat surfaces positioned between said distal end protrusion and said proximal end flared protrusion;

also providing a gear with straight external teeth;

grasping said lower handles;

positioning each of said jaw elements centrally between adjacent ones of said external teeth on opposing sides of said gear;

also positioning said distal end protrusions behind said gear and positioning said proximal end flared protrusions in front of said gear, relative to an operator;

moving said lower handles toward one another to place said five flat surfaces on each of said jaw elements against said external teeth;

applying sufficient rotational pressure to said lower handles to cause said jaw elements to close around said gear and firmly grasp and temporarily hold said gear by said external teeth; and moving said lower handles away from one another when desired to release said gear from between said jaw elements without operator contact with said gear.

16. The method of claim 15 wherein said step of providing said lever members further comprises the step of providing lever members each having flat surfaces positioned at non-90° angles relative to one another.

17. The method of claim 15 wherein said step of providing said lever members further comprises the step of providing lever members each having flat surfaces with length dimensions of approximately two inches.

18. The method of claim 15 wherein said step of providing said lever members further comprises the step of providing lever members each having two flat surfaces positioned adjacent to one another and separated by an angle of approximately 150°, and two additional flat surfaces positioned adjacent to one another and separated by an angle of approximately 135°.

19. The method of claim 15 wherein said step of providing said lever members further comprises the step of providing lever members each having two opposing fillet surfaces on each of said jaw elements with each of said fillet surfaces bordering said flared protrusion and a portion of said flat surfaces.

20. The method of claim 15 wherein said step of providing said lever members further comprises the step of providing lever members each having a shaved surface adjacent to the one of said fillet surfaces that is remote to said bolt, each of said shaved surfaces extending from said remote fillet surface in a direction opposed to said flat surfaces.

* * * * *